US005756418A

United States Patent [19]

Simpson et al.

[11] Patent Number: 5,756,418

[45] Date of Patent: May 26, 1998

[54] BINDER FOR THERMAL TRANSFER DONOR ELEMENT

[75] Inventors: William H. Simpson, Pittsford; Hoa A. Tang, Rochester; Thomas C. Reiter, Hilton, all of N.Y.

[73] Assignee: Eastman Kodak Company, Rochester, N.Y.

[21] Appl. No.: 757,556

[22] Filed: Nov. 27, 1996

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/913, 914, 500

[56] References Cited

U.S. PATENT DOCUMENTS 5,514,637 5/1996 Lum et al. ..... 503/227
5,529,973 6/1996 Shinohara et al. ..... 503/227

*Primary Examiner*—Bruce H. Hess
*Attorney, Agent, or Firm*—Harold E. Cole

[57] ABSTRACT

This invention relates to a thermal transfer donor element comprising a support having thereon a dye layer comprising a dye dispersed in a polymeric binder, the dye layer being capable of being thermally transferred to a receiver element, wherein the polymeric binder is a phenoxy resin.

18 Claims, No Drawings

BINDER FOR THERMAL TRANSFER DONOR ELEMENT

This invention relates to the use of a certain polymeric binder for a thermal transfer donor element. The donor element is used to produce binary text on a thermal receiver element for optical character recognition (OCR) and bar codes which can be read by scanners.

In recent years, thermal transfer systems have been developed to obtain prints from pictures which have been generated electronically from a color video camera. According to one way of obtaining such prints, an electronic picture is first subjected to color separation by color filters. The respective color- separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line- type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye diffusion thermal printing can be used to produce bar codes for use in a diversity of areas including packaging, sales, passports and ID cards. Bar codes require only a binary image composed of a very high density, machine-readable black and a low minimum density. The black density in the bar code can be produced by printing dyes sequentially from yellow, magenta and cyan donor elements to the same area of the thermal receiver or by printing from a single dye- donor element which contains the dye mixture necessary to produce black. The same technique can be used to produce alphanumeric characters which can be optically read. In either case it is necessary to incorporate near infrared dyes or optically recognizable alphanumerics into the bar code to accommodate the various scanning devices used. The spectral response range for scanners is considered to be from 600 to 1000 nm which includes the red and near infrared portions of the electromagnetic spectrum.

The near infrared dyes and visible dyes used in dye diffusion thermal printing must be stable to thermal degradation in the dye-donor element, easily transferred to the thermal receiver at low printing energies, and stable to degradation by heat and light after transfer to the receiver.

The dye-donor of a diffusion thermal transfer system usually contains the dyes and a non-transferable polymeric binder which adheres the dyes to the donor substrate. The polymeric binder is chosen such that sticking of donor to receiver during printing at high densities is minimal, preferably non-existent.

As the time for printing (line time) is decreased, additional energy is applied to the dye-donor element to maintain high dye density in the thermal receiver. As the power increases, the propensity of donor/receiver sticking increases because of the higher temperatures attained, not only because of increased energy but also because of lower heat loss to the surroundings.

U.S. Pat. No. 5,514,637 relates to a typical dye diffusion donor wherein a continuous tone image can be printed rendering the appropriate gray scales. In this system, the binder of the dye-donor element usually does not transfer to the receiving element. There is a problem with using this system to print bar codes, however, in that high levels of dye are required to produce a binary image composed of a very high density, machine-readable black.

It is an object of this invention to provide a thermal transfer donor element wherein higher densities can be obtained than using a dye diffusion transfer element. It is another object of this invention to provide a binder for a thermal transfer donor element which has good adhesion to a receiver element.

These and other objects are achieved in accordance with this invention which relates to a thermal transfer donor element comprising a support having thereon a dye layer comprising a dye dispersed in a polymeric binder, the dye layer being capable of being thermally transferred to a receiver element, wherein the polymeric binder is a phenoxy resin.

Another embodiment of the invention relates to a process of forming a dye transfer image comprising:

a) imagewise-heating the thermal transfer donor element described above, and b) transferring portions of the dye layer to a dye-receiving element to form the dye transfer image.

By using the thermal transfer donor element of the invention, 100% of the dye is transferred (together with the binder) to the receiver during the printing step. Since less dye is used in the thermal transfer donor element, it also has better shelf stability to crystallization since the dye concentration in the polymer is lower.

The binder may be used at any concentration effective for the intended purpose. In general, good results are obtained when the binder is used at a coverage of from about 0.1 to about 5 g/m$^2$. The binder may be present at a concentration of from about 15 to about 35% by weight of the dye layer.

Any phenoxy resin known to those skilled in the art may be used in the invention. For example, there may be employed the following: Paphen® resins such as Phenoxy Resins PKHC®, PKHH® and PKHJ® from Phenoxy Associates, Rock Hill, S.C.; and 045A and 045B resins from Scientific Polymer Products, Inc. Ontario, N.Y. which have a mean number molecular weight of greater than about 10,000. In a preferred embodiment of the invention, the phenoxy resin is a Phenoxy Resin PKHC®, PKHH® or PKHJ® having the following formula:

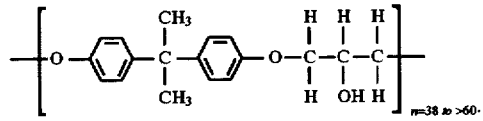

In another embodiment of the invention, various crosslinking agents may be employed with the binder such as titanium alkoxides, polyisocyanates, melamine-formaldehyde, phenol-formaldehyde, urea-formaldehyde, vinyl sulfones and silane coupling agents such as tetraethylorthosilicate. In still another embodiment of the invention, the crosslinking agent is a titanium alkoxide such as titanium tetra-isopropoxide or titanium butoxide. In general, good results have been obtained when the crosslinking agent is present in an amount of from about 0.01 g/m$^2$ to 0.045 g/m$^2$.

Any image dye can be used in the thermal transfer donor element employed in the invention provided it is transferable to the dye-receiving layer by the action of heat. Especially good results have been obtained with any of the dyes used in the examples hereafter or those disclosed in U.S. Pat. No.

4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic. In a preferred embodiment of the invention, a mixture of cyan, magenta and yellow image dyes and an infrared-absorbing dye is employed.

Infrared-absorbing dyes which may be used in the invention include cyanine infrared-absorbing dyes as described in U.S. Pat. No. 4,973,572, or other dyes as described in the following U.S. Pat. Nos.: 4,948,777; 4,950,640; 4,950,639; 4,948,776; 4,948,778; 4,942,141; 4,952,552; 5,036,040; and 4,912,083, the disclosures of which are hereby incorporated by reference.

The dye-receiving element that is used in the invention comprises a support having thereon a dye image-receiving layer. The support may be a transparent film such as a poly(ether sulfone), a polyimide, a cellulose ester such as cellulose acetate, a poly(vinyl alcohol-co-acetal) or a poly (ethylene terephthalate). The support for the dye-receiving element may also be reflective such as baryta- coated paper, polyethylene-coated paper, white polyester (polyester with white pigment incorporated therein), an ivory paper, a condenser paper, a synthetic paper such as DuPont Tyvek®, or a laminated, microvoided, composite packaging film support as described in U.S. Pat. No. 5,244,861.

The dye image-receiving layer may comprise, for example, a polycarbonate, a polyurethane, a polyester, poly (vinyl chloride), poly(styrene-co- acrylonitrile), polycaprolactone or mixtures thereof. The dye image-receiving layer may be present in any amount which is effective for the intended purpose. In general, good results have been obtained at a concentration of from about 1 to about 5 g/m$^2$.

Any material can be used as the support for the thermal transfer donor element of the invention provided it is dimensionally stable and can withstand the heat of the thermal head. Such materials include polyesters such as poly (ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimideamides and polyetherimides. The support generally has a thickness of from about 5 to about 200 μm. It may also be coated with a subbing layer, if desired, such as those materials described in U.S. Pat. Nos. 4,695,288 or 4,737,486.

The reverse side of the thermal transfer donor element may be coated with a slipping layer to prevent the printing head from sticking to the thermal transfer donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

A thermal dye transfer assemblage of the invention comprises a) a thermal transfer donor element as described above, and b) a dye-receiving element as described above, the dye-receiving element being in a superposed relationship with the thermal transfer donor element so that the dye layer of the donor element is in contact with the dye image-receiving layer of the receiving element.

The above assemblage comprising these two elements may be preassembled as an integral unit when an image is to be obtained. This may be done by temporarily adhering the two elements together at their margins. After transfer, the dye-receiving element is then peeled apart to reveal the dye transfer image.

The following example is provided to illustrate the invention:

Example

The following dyes were used in the experimental work:

Yellow Dye 1

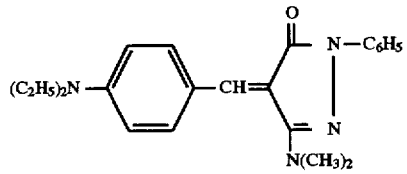

Magenta Dye 2

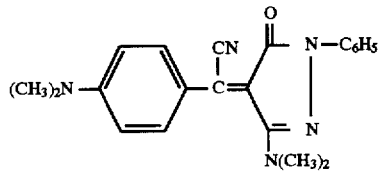

Magenta Dye 3

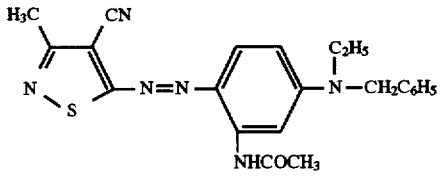

Cyan Dye 4

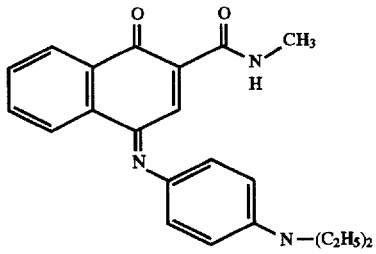

-continued
Cyan Dye 5
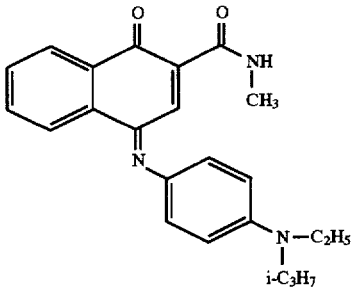
IR-Dye 1
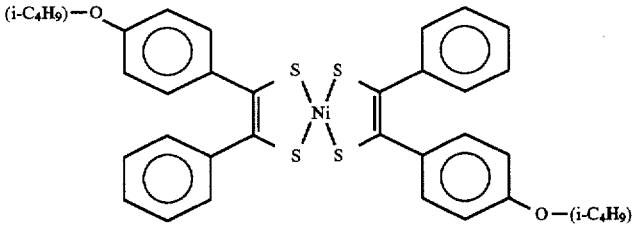
IR-Dye 2
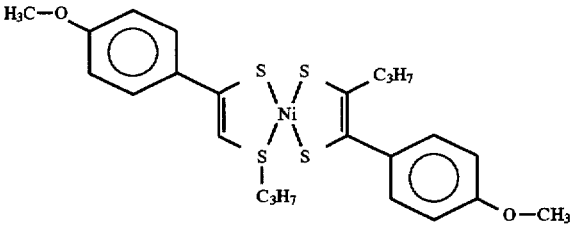
IR-Dye 3
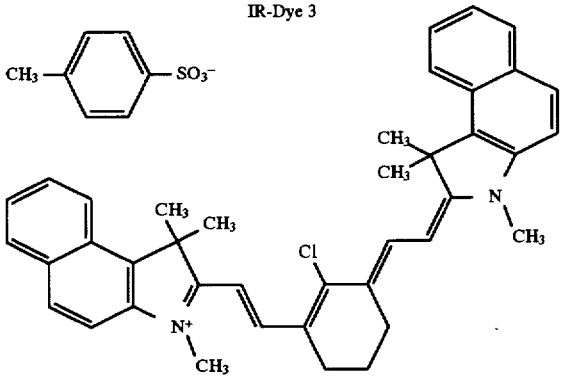
IR-Dye 4
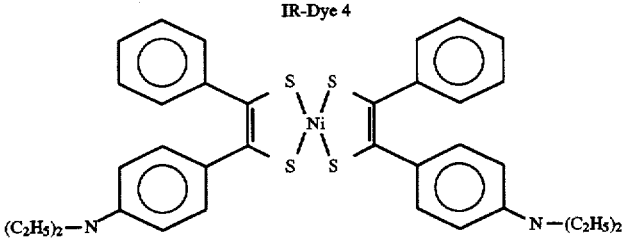
IR-Dye 5
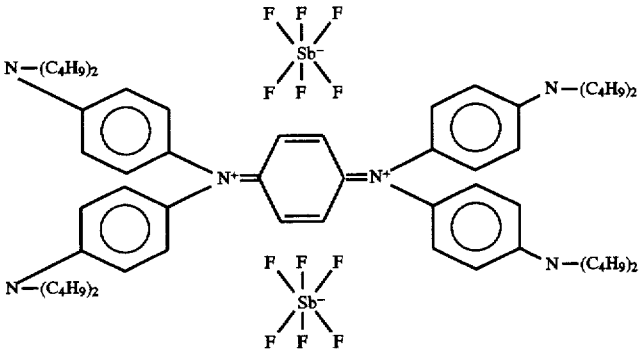
(Cyasorb 165 ® available from Glendale Protective Technologies)

A. Donor Elements

A thermal transfer donor element was prepared by coating on a 6.4 μm poly(ethylene terephthalate) substrate (DuPont) which had been coated with Tyzor TBT® titanium tetrabutoxide (DuPont). On that side of this donor substrate was coated a slipping layer composed of poly(vinyl acetal) (Sekisui) (0.383 g/m$^2$), candelilla wax (Strahl & Pitsch) (0.022 g/m$^2$), p-toluenesulfonic acid (0.0003 g/m$^2$), and PS-513, (an aminopropyl dimethyl terminated polydimethyl siloxane), (United Chemical Technologies) (0.010 g/m$^2$). On the opposite side of the so-prepared donor support was coated one of the dye layers as outlined below, from a toluene/n-propanol/cyclopentanone (60:35:5 wt-%) solvent mixture, using a slot head for delivery. Drying was performed at 38°–43° C.

| MATERIAL | COATING WEIGHT (g/m$^2$) |
|---|---|
| Thermal Transfer Donor 1 | |
| Dye 1 | 0.150 |
| Dye 2 | 0.226 |
| Dye 3 | 0.040 |
| Dye 4 | 0.226 |
| Dye 5 | 0.323 |
| IR-Dye 1 | 0.430 |
| IR-Dye 2 | 0.108 |
| 2 μm divinylbenzene beads | 0.027 |
| PKHJ ® phenoxy resin | 0.677 |
| Thermal Transfer Donor 2 | |
| Dye 1 | 0.105 |
| Dye 2 | 0.158 |
| Dye 3 | 0.028 |
| Dye 4 | 0.158 |
| Dye 5 | 0.226 |
| IR-Dye 1 | 0.430 |
| IR-Dye 2 | 0.108 |
| 2 μm divinylbenzene beads | 0.027 |
| PKHJ ® phenoxy resin | 0.677 |
| Thermal Transfer Donor 3 | |
| Dye 1 | 0.060 |
| Dye 2 | 0.090 |
| Dye 3 | 0.016 |
| Dye 4 | 0.090 |
| Dye 5 | 0.129 |
| IR-Dye 1 | 0.430 |
| IR-Dye 2 | 0.108 |
| 2 μm divinylbenzene beads | 0.027 |
| PKHJ ® phenoxy resin | 0.677 |

Thermal Transfer Donor 4

This was the same as Thermal Transfer Donor 3 except that IR-Dyes 1 and 2 were replaced by IR-Dye 5 and IR-Dye 3.

Thermal Transfer Donor 5

This was the same as Thermal Transfer Donor 3 except that the level of phenoxy resin was reduced to 0.538 g/m$^2$.

Thermal Transfer Donor 6

This was the same as Thermal Transfer Donor 3 except that the level of phenoxy resin was reduced to 0.269 g/m$^2$.

Thermal Transfer Donor 7 (Comparison)

This was the same as Thermal Transfer Donor 2 except that the KS-1 (polyvinylacetal, Sekisui) was used in place of the PKHJ phenoxy resin.

Thermal Transfer Donor 8

This was the same as Thermal Transfer Donor 4 except that IR-Dye 4 was substituted for IR-Dye 5.

Control Dye-Donor

The formulation was designed to function as a dye diffusion thermal transfer donor with cellulose acetate propionate (CAP) as the binder which did not stick to the receiver. The materials and coating weights were as follows:

| MATERIAL | COATING WEIGHT (g/m$^2$) |
|---|---|
| Dye 1 | 0.150 |
| Dye 2 | 0.226 |
| Dye 3 | 0.040 |
| Dye 4 | 0.226 |
| Dye 5 | 0.323 |
| IR-Dye 1 | 0.430 |
| IR-Dye 2 | 0.108 |
| 2 μm divinylbenzene beads | 0.027 |
| CAP 482-20 (20 sec viscosity) (Eastman Chemical Co.) | 0.074 |
| CAP 482-0.5 (0.5 sec viscosity) (Eastman Chemical Co.) | 0.602 |
| Fluorad ® FC-430 (fluorosurfactant) (3M Corp.) | 0.011 |

B. Receiver Element

The receiver element consisted of four layers coated on 175 μm Estar® (Eastman Kodak Co.) support.

The first layer, which was coated directly onto the support, consisted of a copolymer of butyl acrylate and acrylic acid (50/50 wt. %) at 8.07 g/m$^2$, 1,4-butanediol diglycidyl ether (Eastman Kodak) at 0.565 g/m$^2$, tributylamine at 0.323 g/m$^2$, Fluorad® FC-431 (3M Corp.) at 0.016 g/m$^2$.

The second layer consisted of a copolymer of 14 mole-% acrylonitrile, 79 mole-% vinylidine chloride and 7 mole-% acrylic acid at 0.538 g/m$^2$, and DC-1248 silicone fluid (Dow Corning) at 0.016 g/m$^2$.

The third layer consisted of Makrolon® KL3-1013 polycarbonate (Bayer AG) at 1.77 g/m$^2$, Lexan 141-112 polycarbonate (General Electric Co.) at 1.45 g/m$^2$, Fluorad® FC-431 at 0.011 g/m$^2$, dibutyl phthalate at 0.323 g/m$^2$, and diphenylphthalate at 0.323 g/m$^2$.

The fourth, topmost layer of the receiver element, consisted of a copolymer of 50 mole-% bisphenol A, 49 mole-% diethylene glycol and 1 mole-% of a polydimethylsiloxane block at a laydown of 0.646 g/m$^2$, Fluorad® FC-431 at 0.054 g/m$^2$, and DC-510 (Dow Corning) at 0.054 g/m$^2$.

C. Printing Conditions

The dye side of a donor element as described above was placed in contact with the topmost layer of the receiver element. The assemblage was placed between a motor driven platen (35 mm in diameter) and a Kyocera KBE-57-12MGL2 thermal print head which was pressed against the slip layer side of the thermal transfer donor element with a force of 31.2 Newtons.

The Kyocera print head has 672 independently addressable heaters with a resolution of 11.81 dots/mm of 1968Ω average resistance. The imaging electronics were activated and the assemblage was drawn between the printing head and the roller at 26.67 mm/sec. Coincidentally, the resistance elements in the thermal print head were pulsed on for 87.5 microseconds every 91 microseconds. Printing maximum density required 32 pulses "on" time per printed line of 3.175 milliseconds. The maximum voltage supplied was 12.0 volts resulting in an energy of 3.26 J/cm$^2$ to print a maximum Status A density of 2.2 to 2.3. The image was printed with a 1:1 aspect ratio.

The results in Table I represent the Status A densities measured with an X-Rite densitometer(X-Rite Corp.) in the visible region and the infrared densities obtained at 820 and 915 nm using a Lambda 12 Spectrophotometer with an integrating sphere from Perkin-Elmer Corporation.

TABLE I

| Thermal Transfer Donor Element | Status A Red | Status A Green | Status A Blue | Density Region 820 nm | Density Region 915 nm |
|---|---|---|---|---|---|
| 1 | 2.98 | 2.99 | 2.81 | 1.10 | 1.11 |
| 2 | 2.70 | 2.70 | 2.63 | 1.16 | 1.16 |
| 3 | 2.55 | 2.46 | 2.21 | 1.16 | 1.12 |
| 4 | 2.99 | 2.79 | 2.54 | 1.16 | 0.77 |
| 5 | 2.59 | 2.64 | 2.32 | 1.19 | 1.18 |
| 6 | 2.60 | 2.52 | 2.29 | 1.12 | 1.09 |
| 7 (Comparison) | 2.59 | 2.56 | 2.53 | 1.20 | 1.17 |
| 8 | 2.46 | 2.27 | 2.22 | 1.16 | 0.78 |
| Control | 0.64 | 0.59 | 0.57 | 0.17 | 0.22 |

The above results show that the values for the Thermal Transfer Donors 1 through 8 indicate substantial density increases in the printed receiver over that for the dye diffusion control for both the visible and infrared regions of the spectrum. This was found even when the dye level of the visible dyes had been decreased by 60% (Thermal Transfer Donor 3) from that of the dye diffusion control. Whereas Thermal Transfer Dye-Donor 7 gave high density values, it exhibited lower adhesion to the receiver surface (see below) than did the Thermal Transfer Donors of the invention.

Adhesion Test

Adhesion was measured by a Scotch® tape pull test of the receiver having the following test materials transferred thereto: Elvacite® 1010 and 1020 acrylic resins (ICI Acrylics), Matrimid® 5218 polyamide (Ciba-Geigy), polyvinylacetal (Sekisui) and PKHJ® phenoxy resin (Phenoxy Associates). The Scotch® tape was applied with finger pressure and rapidly pulled off. The following results were obtained:

TABLE II

| MATERIAL | ADHESION QUALITY |
|---|---|
| Elvacite ® 1010 | X |
| Elvacite ® 1020 | X |
| Matrimid ® | X |
| poly(vinyl acetal) | O |
| PKHJ ® phenoxy resin (Phenoxy Associates) | + |

X = poor
O = fair
+ = excellent

The above results show that the acrylic resins (Elvacite®) and polyamide (Matrimid®) both have poor adhesion to the topmost layer of thermal receiver elements containing polysiloxanes. Poly(vinyl acetal) gave moderate adhesion, whereas the phenoxy resin adhered very well to the receiver element.

Bar Code Printing Test

Scans were performed on a scanner from Kronos Inc. The bar codes for this test were printed at a line time of 3.175 milliseconds at an applied power of 3.26 J/cm$^2$. The bar code was scanned 10 times. The following results were obtained:

TABLE III

| Sample | Performance* |
|---|---|
| Dye Diffusion Dye-Donor (control) | 0/10 |
| Thermal Transfer Donor 1 | 10/10 |
| Thermal Transfer Donor 2 | 10/10 |
| Thermal Transfer Donor 3 | 10/10 |
| Thermal Transfer Donor 4 | 10/10 |
| Thermal Transfer Donor 5 | 10/10 |
| Thermal Transfer Donor 6 | 10/10 |
| Thermal Transfer Donor 7 (comparison) | 0/10 |
| Thermal Transfer Donor 8 | 10/10 |

*Performance is the number of correct scans per number attempted.

The above results show that when a bar code printed from Thermal Transfer Donors 1 through 6 and Thermal Transfer Donor 8 is compared to a bar code from the dye diffusion control, the readability is better (10 correct scans per 10 attempts) than that of the dye diffusion control (0 correct scans per 10 attempts). Thermal Transfer Donor 7 gave poor readability because of the poorer adhesion of the poly(vinyl acetal) binder to the receiver surface (see Table II).

Daylight Exposure Test

The printed samples were exposed to a Xenon lamp at an intensity of 50 Klux for 7 days. The spectral output of the lamp was adjusted to a daylight exposure with appropriate filters. The absorbance at 820 nm and 915 nm was measured using a Perkin Elmer Lambda 12 spectrophotometer (Perkin Elmer Corp.) before and after exposure to the lamp and the % absorbance change was calculated. The following results were obtained:

TABLE IV

| Sample | % Absorbance Change of Infrared Dyes 820 nm | % Absorbance Change of Infrared Dyes 915 nm |
|---|---|---|
| Dye Diffusion Dye-Donor (Control) | −30 | −26 |
| Thermal Transfer Donor 1 | 2 | 4 |

The above results show that IR-Dye 1 and IR-Dye 2 (Dye-Donor 1) show excellent stability to fading by exposure to daylight compared to the control produced by dye diffusion.

The invention has been described in detail with particular reference to preferred embodiments thereof, but it will be understood that variations and modifications can be effected within the spirit and scope of the invention.

What is claimed is:

1. A thermal transfer donor element comprising a support having thereon a dye layer comprising a dye dispersed in a polymeric binder, said dye layer being capable of being thermally transferred to a receiver element, wherein said polymeric binder is a phenoxy resin and said element contains a separate infrared-absorbing dye or said dye is an infrared-absorbing dye.

2. The element of claim 1 wherein said binder is present at a concentration of from about 15 to about 35% by weight of said dye layer.

3. The element of claim 1 wherein said phenoxy resin comprises

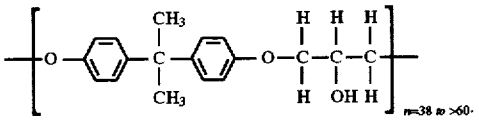

4. The element of claim 1 wherein said dye comprises an image dye.

5. The element of claim 1 wherein said dye comprises an infrared-absorbing dye.

6. The element of claim 1 wherein said dye layer comprises a mixture of cyan, magenta and yellow image dyes and an infrared-absorbing dye.

7. A process of forming a dye transfer image comprising:

a) imagewise-heating a thermal transfer donor element comprising a support having thereon a dye layer comprising a dye dispersed in a polymeric binder, and b) transferring portions of said dye layer to a dye-receiving element to form said dye transfer image, wherein said polymeric binder is a phenoxy resin and said donor element contains a separate infrared-absorbing dye or said dye is an infrared-absorbing dye.

8. The process of claim 7 wherein said binder is present at a concentration of from about 15 to about 35% by weight of said dye layer.

9. The process of claim 7 wherein said phenoxy resin comprises

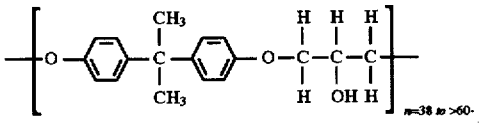

10. The process of claim 7 wherein said dye comprises an image dye.

11. The process of claim 7 wherein said dye comprises an infrared-absorbing dye.

12. The process of claim 7 wherein said dye layer comprises a mixture of cyan, magenta and yellow image dyes and an infrared-absorbing dye.

13. A thermal dye transfer assemblage comprising:

a) a thermal transfer donor element comprising a support having thereon a dye layer comprising a dye dispersed in a polymeric binder, said dye layer being capable of being thermally transferred to a receiver element, and b) a receiver element comprising a support having thereon an image-receiving layer, said receiver element being in superposed relationship with said thermal transfer donor element so that said dye layer is in contact with said image-receiving layer, wherein said polymeric binder is a phenoxy resin and said donor element contains a separate infrared-absorbing dye or said dye is an infrared-absorbing dye.

14. The assemblage of claim 13 wherein said binder is present at a concentration of from about 15 to about 35% by weight of said dye layer.

15. The assemblage of claim 13 wherein said phenoxy resin comprises

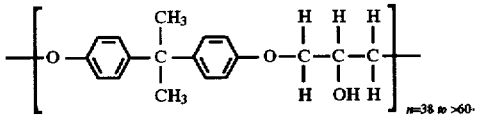

16. The assemblage of claim 13 wherein said dye comprises an image dye.

17. The assemblage of claim 13 wherein said dye comprises an infrared-absorbing dye.

18. The assemblage of claim 13 wherein said dye layer comprises a mixture of cyan, magenta and yellow image dyes and an infrared-absorbing dye.

* * * * *